US009542875B2

(12) United States Patent
Yang et al.

(10) Patent No.: US 9,542,875 B2
(45) Date of Patent: Jan. 10, 2017

(54) SIGNAL PROCESSING METHOD, SIGNAL PROCESSOR, AND DISPLAY DEVICE INCLUDING SIGNAL PROCESSOR

(71) Applicant: Samsung Display Co., Ltd., Yongin (KR)

(72) Inventors: Ji-Yeon Yang, Yongin (KR); Geun-Young Jeong, Yongin (KR); Myung-Ho Lee, Yongin (KR); Jeong-Eun Kim, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 277 days.

(21) Appl. No.: 14/256,551

(22) Filed: Apr. 18, 2014

(65) Prior Publication Data

US 2015/0015600 A1 Jan. 15, 2015

(30) Foreign Application Priority Data

Jul. 15, 2013 (KR) ..... 10-2013-0083015

(51) Int. Cl.
*G09G 3/20* (2006.01)

(52) U.S. Cl.
CPC .... *G09G 3/2003* (2013.01); *G09G 2300/0452* (2013.01); *G09G 2320/0276* (2013.01); *G09G 2340/0457* (2013.01)

(58) Field of Classification Search
CPC ..... G09G 3/2003; G09G 3/2074; G09G 2340/0457; G09G 2340/0485; G09G 2320/0276;G09G 2300/0439; G09G 2300/0452
See application file for complete search history.

(56) References Cited

U.S. PATENT DOCUMENTS 6,882,364 B1 * 4/2005 Inuiya ..... H04N 9/045 348/237
2007/0285442 A1 * 12/2007 Higgins ..... G09G 3/20 345/690
2009/0302331 A1 * 12/2009 Smith ..... H01L 27/3211 257/88

(Continued)

FOREIGN PATENT DOCUMENTS

KR 10-2007-0099847 10/2007
KR 10-2008-0011659 2/2008

(Continued)

*Primary Examiner* — Jacinta M Crawford
*Assistant Examiner* — Phuc Doan
(74) *Attorney, Agent, or Firm* — Cantor Colburn LLP

(57) ABSTRACT

A method of signal-processing input image data of a display device including a plurality of pixels, each pixel including a green subpixel and one of a red subpixel and a blue subpixel, the method includes: performing a gamma-conversion on input image data corresponding to the one of the red subpixel and the blue subpixel in each pixel; distributing the gamma-converted input image data corresponding to a center pixel to image data of a pixel in a vertical direction based on the center pixel by a first ratio; and distributing the gamma-converted input image data corresponding to the center pixel to image data of a pixel in a horizontal direction based on the center pixel by a second ratio, where the green subpixel and the one of the red subpixel and the blue subpixel are diagonally disposed in each pixel.

18 Claims, 6 Drawing Sheets

(56) References Cited

U.S. PATENT DOCUMENTS

| | | | | |
|---|---|---|---|---|
| 2010/0045695 | A1* | 2/2010 | Brown Elliott | G09G 3/2003 345/589 |
| 2010/0149204 | A1* | 6/2010 | Han | G09G 5/02 345/589 |
| 2010/0225567 | A1* | 9/2010 | Koebrich | G09G 3/20 345/55 |
| 2010/0259697 | A1* | 10/2010 | Sakamoto | G02B 27/2214 349/15 |
| 2011/0037786 | A1* | 2/2011 | Hasegawa | G09G 5/10 345/690 |
| 2012/0026216 | A1* | 2/2012 | Brown Elliott | G09G 3/20 345/694 |
| 2012/0220823 | A1* | 8/2012 | Choe | A61B 1/00009 600/109 |
| 2014/0071175 | A1* | 3/2014 | Yang | G09G 3/3208 345/690 |
| 2014/0097760 | A1* | 4/2014 | Kato | H05B 37/02 315/192 |

FOREIGN PATENT DOCUMENTS

| | | |
|---|---|---|
| KR | 10-2009-0122307 | 11/2009 |
| KR | 10-2014-0034500 | 3/2014 |

* cited by examiner

SIGNAL PROCESSING METHOD, SIGNAL PROCESSOR, AND DISPLAY DEVICE INCLUDING SIGNAL PROCESSOR

This application claims priority to Korean Patent Application No. 10-2013-0083015, filed on Jul. 15, 2013, and all the benefits accruing therefrom under 35 U.S.C. §119, the content of which in its entirety is herein incorporated by reference.

BACKGROUND (a) Field

Exemplary embodiments of the invention relate to a signal processing method, a signal processor, and a display device including the signal processor. More particularly, the exemplary embodiments relate to a display device having a pentile structure, and a signal processing method and a signal processor of the display device having the pentile structure.

(b) Description of the Related Art

A pixel of a conventional display device typically includes red, green and blue subpixels. In general, the pixel of the conventional display device has a stripe structure where red, green and blue subpixels are vertically arranged in a unit pixel area.

Alternatively, the pixel may have a pentile structure, where only some of red, green and blue subpixels are provided in the unit pixel area, or some of red, green and blue subpixels are provided only in a predetermined region of the unit pixel area.

Since the number of subpixels per unit pixel or an area of the subpixels per unit pixel is small in the pentile structure, pixel performance per unit area of the pentile structure may be lower than pixel performance per unit area of the stripe structure.

SUMMARY

Exemplary embodiments provide a signal processing method, a signal processor for processing a signal, and a display device having a pentile structure and including the signal processor.

An exemplary embodiment provides a method of processing input image data of a display device including a plurality of pixels, each including a green subpixel and one of a red subpixel and a blue subpixel, the method including: performing a gamma-conversion on input image data corresponding to the one of the red subpixel and the blue subpixel in each pixel; distributing the gamma-converted input image data corresponding to a center pixel to image data of a pixel in a vertical direction based on the center pixel by a first ratio; and distributing the gamma-converted input image data corresponding to the center pixel to image data of a pixel in a horizontal direction based on the center pixel by a second ratio, where the green subpixel and the one of the red subpixel and the blue subpixel are diagonally disposed in each pixel.

In an exemplary embodiment, the method may further include distributing the gamma-converted input image data corresponding to the center pixel to image data of the center pixel by a third ratio.

In an exemplary embodiment, the method may further include: distributing the gamma-converted input image data corresponding to another pixel in the vertical direction based on the center pixel to the image data of the center pixel by the first ratio; and distributing the gamma-converted input image data corresponding to another pixel in the horizontal direction based on the center pixel to the image data of the center pixel by the second ratio.

In an exemplary embodiment, the method may further include performing an inverse-gamma conversion on the image data of the center pixel.

In an exemplary embodiment, the signal processing method may further include summing input image data of the green subpixel of the center pixel and the inverse-gamma-converted image data of the center pixel to output an output image data of the center pixel.

Another exemplary embodiment provides a signal processor for processing input image data of a display device including a plurality of pixels, each including a green subpixel and one of a red subpixel and a blue subpixel, the signal processor including: an input gamma unit which performs a gamma-conversion on input image data corresponding to the one of the red subpixel and the blue subpixel in each pixel; a subpixel rendering unit which distributes the gamma-converted input image data corresponding to a center pixel to image data corresponding to a pixel in the vertical direction based on the center pixel by a first ratio, and distributes the gamma-converted input image data corresponding to the center pixel to image data of a pixel in the horizontal direction based on the center pixel by a second ratio, where the green subpixel and the one of the red subpixel and the blue subpixel are diagonally disposed in each pixel.

In an exemplary embodiment, the subpixel rendering unit may distribute the gamma-converted input image data corresponding to the center pixel to image data of the center pixel by a third ratio.

In an exemplary embodiment, the subpixel rendering unit may distribute the gamma-converted input image data corresponding to another pixel in the vertical direction in image data based on the center pixel to the image data of the center pixel by the first ratio, and distributes the gamma-converted input image data corresponding to another pixel in the horizontal direction based on the center pixel to the image data of the center pixel by the second ratio to generate the image data of the center pixel.

In an exemplary embodiment, the signal processor may further include an output gamma unit which performs an inverse gamma-conversion on the image data of the center pixel.

In an exemplary embodiment, the signal processor may further include an output interface which sums input image data of the green subpixel and the inverse-gamma-converted image data of the center pixel to output an output image data of the center pixel.

Another exemplary embodiment provides a display device including: a plurality of pixels, each pixel including a green subpixel and one of a red subpixel and a blue subpixel, where the green subpixel and the one of the red subpixel and the blue subpixel are diagonally disposed in each pixel; and a signal processor which performs a gamma-conversion on input image data corresponding to the one of the red subpixel and the blue subpixel in each pixel, distributes the gamma-converted input image data corresponding to a center pixel to image data corresponding to a pixel in a vertical direction based on the center pixel by a first ratio, and distributes the gamma-converted input image data corresponding to the center pixel to image data of a pixel in a horizontal direction based on the center pixel by a second ratio.

In an exemplary embodiment, the signal processor may distribute the gamma-converted input image data corresponding to the center pixel to image data of the center pixel by a third ratio.

In an exemplary embodiment, the signal processor may distribute the gamma-converted input image data corresponding to another pixel in the vertical direction in image data based on the center pixel to the image data of the center pixel by the first ratio, and distributes the gamma-converted input image data corresponding to another pixel in the horizontal direction based on the center pixel to the image data of the center pixel by the second ratio to generate the image data of the center pixel.

In an exemplary embodiment, the signal processor may include an output gamma unit which performs an inverse gamma-conversion on the image data of the center pixel.

In an exemplary embodiment, the signal processor may further include an output interface which sums input image data of the green subpixel and the inverse-gamma-converted image data of the center pixel to output an output image data of the center pixel.

In an exemplary embodiment, a sum of the first ratio, the second ratio, and the third ratio may be one.

Exemplary embodiments of the invention provide the signal processor of a display device having a pentile structure, the method of processing input image data of the display device, and the display device including the signal processor.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
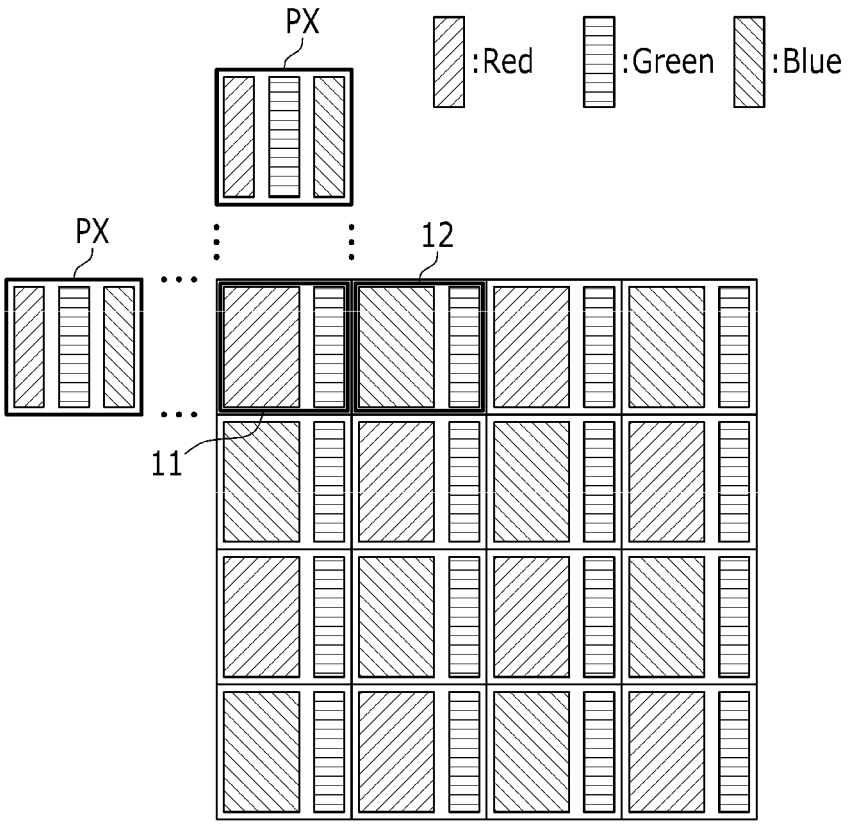
FIG. 1 is a diagram illustrating pixels having a pentile structure including a plurality of subpixels which are disposed in vertical-horizontal directions.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, the element or layer can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to accompanying drawings.

FIG. 1 is a diagram illustrating pixels including a plurality of subpixels having a pentile structure, which are disposed in a vertical-horizontal direction.

Figure 2:
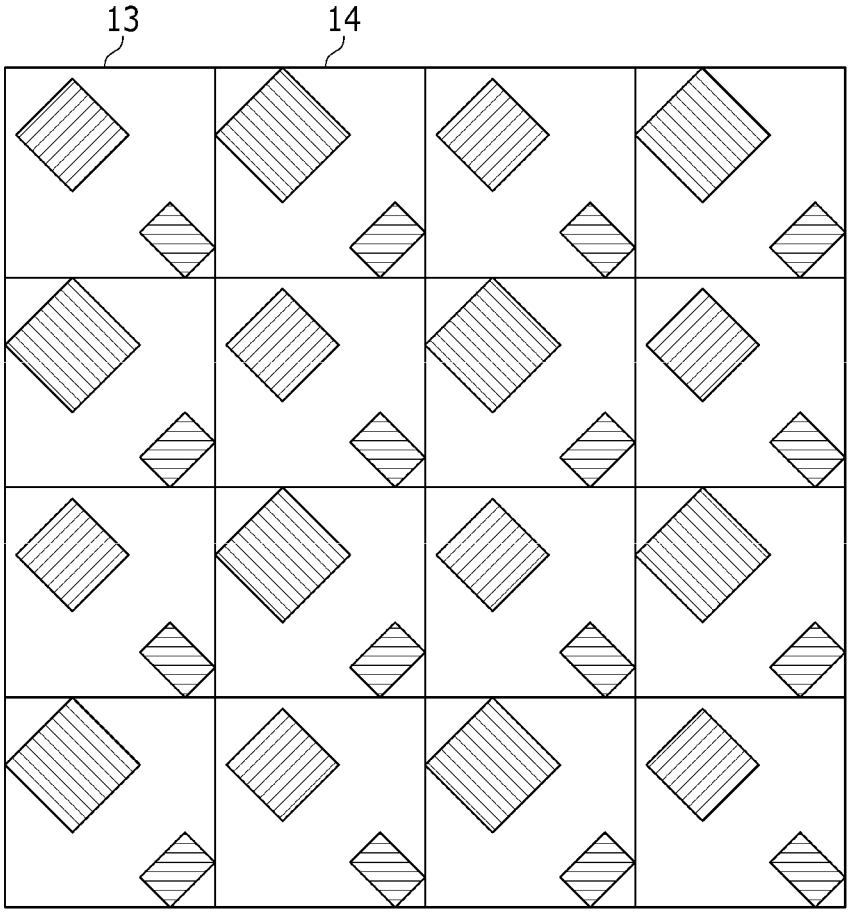
FIG. 2 is a diagram illustrating pixels having an S-pentile structure.

FIG. 2 is a diagram illustrating pixels in an S-pentile structure.

FIG. 1 and FIG. 2 illustrate some of a plurality of pixels of an exemplary embodiment of a display device.

In the drawings, a red subpixel is expressed as an oblique line "/", a green subpixel is expressed as a horizontal line "—", and a blue subpixel is expressed as an oblique line "\".

In the pixels including red, green and blue subpixels arranged the S-pentile structure, the red subpixel and the green subpixel are disposed in a diagonal direction in a pixel area, and the blue subpixel and the green subpixel are disposed in the diagonal direction in the pixel area.

As shown in FIG. 1, in the pixels having a pentile structure in vertical-horizontal directions, one of a first pixel 11 including a red subpixel and a green subpixel and a second pixel 12 including a blue subpixel and a green subpixel is disposed in a pixel area.

In an exemplary embodiment, as shown in FIG. 1, a plurality of first pixels and a plurality of second pixels 12 are alternately arranged in vertical-horizontal directions in a region which 4×4 pixels PX are arranged.

In an alternative exemplary embodiment, the pixels may have the S-pentile structure as shown in FIG. 2. In such an embodiment, a first pixel 13 including a red subpixel and a green subpixel disposed in a diagonal direction and a second pixel 14 including a blue subpixel and a green subpixel disposed in the diagonal direction are alternately arranged in the horizontal-vertical directions.

Since pixels in the pentile structure shown in FIG. 1 and FIG. 2 has a lesser number of sub-pixels in a pixel area than pixels in the stripe structure, a subpixel rendering ("SPR") scheme may be applied to an exemplary embodiment of the display device having the pentile structure for a data processing thereof. In such an embodiment, pixel expression is reduced according to the reduced number of pixels. In such an embodiment, a rendering scheme for sharing image data between adjacent pixels is applied to a display device having the pentile structure as the SPR scheme to compensate the reduced pixel expression.

In such an embodiment, the SPR scheme may use various types of filters. In one exemplary embodiment, for example, the filters include a D filter, a DS filter and an HB filter.

The D filter uses a basic scheme which applies the greatest center weight value to image data of a center pixel in a 3×3 mask, and distributes image data of the center pixel in upper/lower/left/right directions.

The DS filter has a characteristic of relatively emphasizing sharpness by increasing a weight value of a center to be greater than a weight value of a center of the D filter, and slightly reducing a value of an edge.

The HB filter shares insufficient image data of the red or blue subpixel in an input direction. The HB filter is simpler than other filters such that a processing rate is high and the HB filter may be implemented by only using a 2×1 mask rather than a 3×3 mask. Accordingly, the number of line buffers of the HB filter used for filtering is less than other filters. For example, other filters having the 3×3 mask may use additional two line buffers as compared to the HB filter using the 2×1 mask.

In the D filter and the DS filter, image data of the center pixel is widely scattered (as compared with the HB filter) such that an image blur may be viewed. The HB filter may share image data only between adjacent pixels in a horizontal direction to provide better image quality.

However, in an exemplary embodiment, where subpixels are disposed in a diagonal direction in the S-pentile structure, the pixel structure is asymmetrical. Accordingly, the HB filter where image data are shared in a horizontal direction may not be effectively applied to the S-pentile structure. When the HB filter is applied to the S-pentile structure, the pixels are divided into an red/blue ("R/B") group including upper red and blue subpixels and a green ("G") group including lower green subpixels such that a divided image may be viewed.

Figure 3:
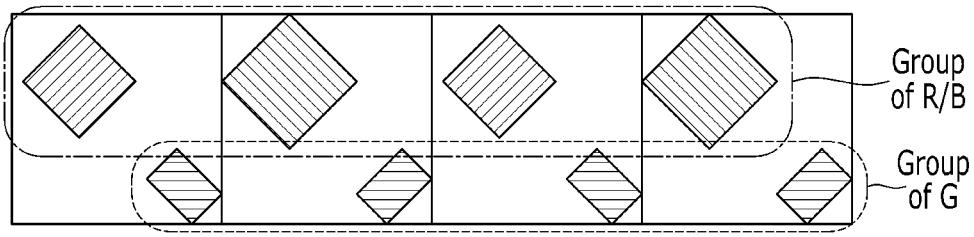
FIG. 3 is a diagram illustrating a portion of a pixel row of pixels in the S-pentile structure.

FIG. 3 is a diagram illustrating a portion of a pixel row of pixels in the S-pentile structure.

As shown in FIG. 3, the R/B group and the G group are distinguished from each other. Particularly, only the G group is disposed at a lower side, and if a conventional filter is used, a color shift may be viewed when a white letter is displayed. That is, the white letter of the upper R/B group is pinkishly viewed, and the white letter of the lower G group is greenishly viewed. Accordingly, the G group may be easily distinguished due to high luminance of the G group than the R/B group such that a color separation occurs, and a color shift (e.g., the white letter is colored) thereby occurs. This may deteriorate image quality.

A plurality of red image data and a plurality of blue image data corresponding to a plurality of pixels included in a unit mask may be distributed in red image data or blue image data corresponding to other adjacent pixels by an exemplary embodiment of a filter according to the invention. In such an embodiment, the red image data and the blue image data are rendered by an exemplary embodiment of a filter. Since the green subpixel is included in all pixels, separate signal processing for green image data corresponding to a green subpixel may not be performed.

Hereinafter, red image data or blue image data not passed through the filter will be referred to as an input image data, e.g., a first input image data or a second input image data, and rendered red image data or blue image data passed through the filter will be referred to as an image data, e.g., a first image data or a second image data.

Figure 4:
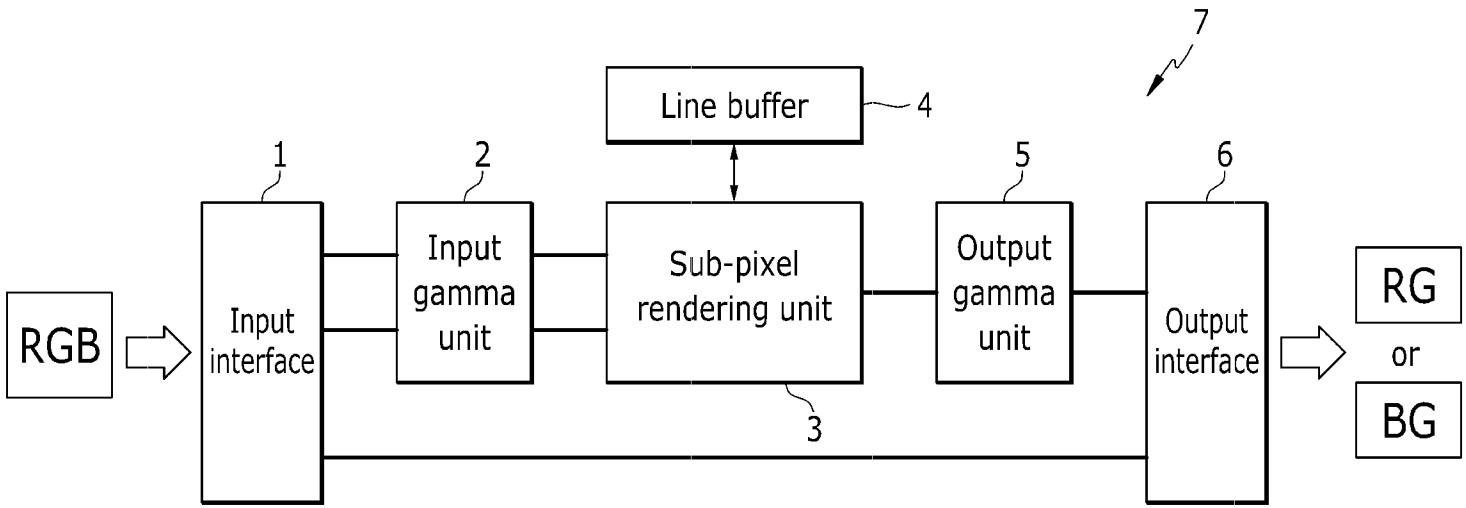
FIG. 4 is a block diagram illustrating an exemplary embodiment of a signal processor including a rendering device according to the invention.

FIG. 4 is a block diagram illustrating an exemplary embodiment of a signal processor including a rendering device according to the invention.

Referring to FIG. 4, in an exemplary embodiment, the rendering device of the signal processor 7 may be a subpixel rendering unit 3.

An exemplary embodiment of the signal processor 7 includes an input interface 1, an input gamma unit 2, the subpixel rendering unit 3, a line buffer 4, an output gamma unit 5 and an output interface 6. The signal processor 7 receives an input video signal RGB, and generates an output image data, e.g., red-green image data RG and blue-green image data BG.

The input video signal RGB is input through the input interface 1. The input video signal RGB includes red image data, green image data and blue image data. The input interface 1 transfers the first input image data and the second input image data to the input gamma unit 2.

The input gamma unit 2 converts the first input image data and the second input image data based on gamma characteristics to output converted data.

In an exemplary embodiment, the subpixel rendering unit 3 renders the first input image data and the second input image data passed through the input gamma unit 2 using an HBV filter.

Figure 5:
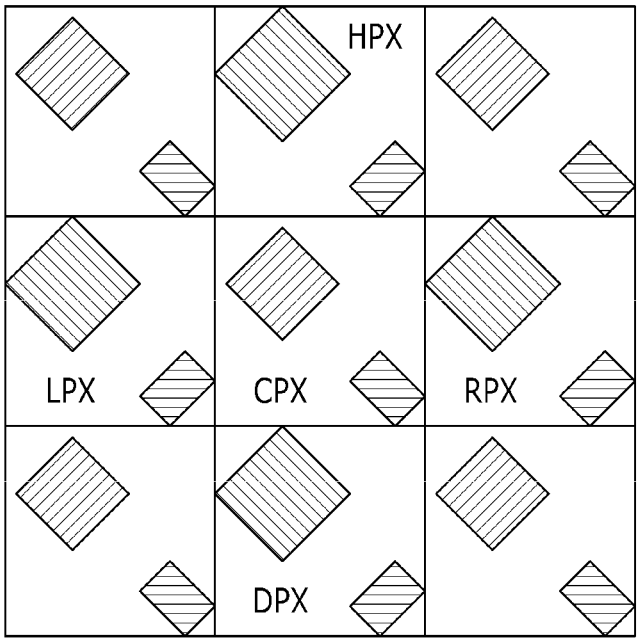
FIG. 5 is a diagram illustrating pixels corresponding to a mask of an exemplary embodiment of a filter.

FIG. 5 is a diagram illustrating pixels corresponding to a mask of an exemplary embodiment of a filter. In an exemplary embodiment, the pixels may be 3×3 pixels corresponding to a 3×3 mask. In such an embodiment, as shown in FIG. 5, the pixels may include a center pixel CPX including a red subpixel, an upper pixel HPX including a blue subpixel, and a left pixel LPX including a blue subpixel.

In an exemplary embodiment, the mask may be an HVB filter. In such an embodiment, the HVB filter divides the first input image data of the center pixel CPX into second input image data corresponding to another pixel of a horizontal direction in a mask, e.g., the left pixel LPX, and the second input image data corresponding to another pixel in the vertical direction, e.g., the upper pixel HPX.

In such an embodiment, another pixel in the horizontal direction may be a pixel located at a left side based on the center pixel, and another pixel in the vertical direction may be a pixel located at an upper side based on the center pixel, but not being limited thereto.

In an exemplary embodiment, the HVB filter may be expressed by the following Equation 1.

Equation 1 shows an exemplary embodiment of the HVB filter where the size of the mask is 3×3. The size of the mask may be changed based on a design, and is not limited thereto.

$$HVB = \begin{bmatrix} 0 & 1/4 & 0 \\ 1/4 & 1/2 & 0 \\ 0 & 0 & 0 \end{bmatrix} * (R/B) \qquad \text{Equation 1}$$

In Equation 1, R/B denotes input image data of the center pixel. That is, input image data of a red subpixel or a blue subpixel of the center pixel is referred to as R/B.

In such an embodiment, a half of the first input image data of the center pixel CPX is divided as the first image data of the center pixel CPX, a quarter of the first input image data of the center pixel CPX is divided as the second image data corresponding to an upper pixel HPX, and a quarter of the first input image data of the center pixel CPX is divided as the second image data of the left pixel LPX.

In such a manner, where the first input image data are divided by the HVB filter, the second input image data of each of a lower pixel DPX and a right pixel RPX are divided in the first image data of the center pixel CPX. In such an embodiment, the first image data of the center pixel CPX is calculated as a half of the first input image data of the center pixel CPX, a quarter of the second input image data of the lower pixel DPX, and a quarter of the second input image data of the right pixel RPX.

The line buffer 4 stores input image data, to which a filter is applied in the subpixel rendering unit 3. In such an embodiment, image data are divided in the upper pixel based on the center pixel, the filter may include a line buffer to store only a single line.

If the subpixel rendering unit 3 renders image data using a D filter or a DS filter, where image data are divided in the upper pixel and the lower pixel based on the center pixel, the line buffer 4 may include a line buffer to store at least two lines. In an exemplary embodiment, as described above, the subpixel rendering unit 3 including the HVB filter may reduce the size of the line buffer 4.

The output gamma unit 5 performs an inverse-gamma conversion on the image data output from the subpixel rendering unit 3, and outputs the inverse-gamma-converted image data to the output interface 6.

The output interface 6 sums the inverse-gamma-converted image data and input image data of the green subpixel, that is, green image data input from the output gamma unit 5, to output the output image data, e.g., red-green image data or blue-green image data.

As described above, in an exemplary embodiment, the color shift in a horizontal direction may be effectively removed by adding a filter to a vertical direction component.

Figure 6:
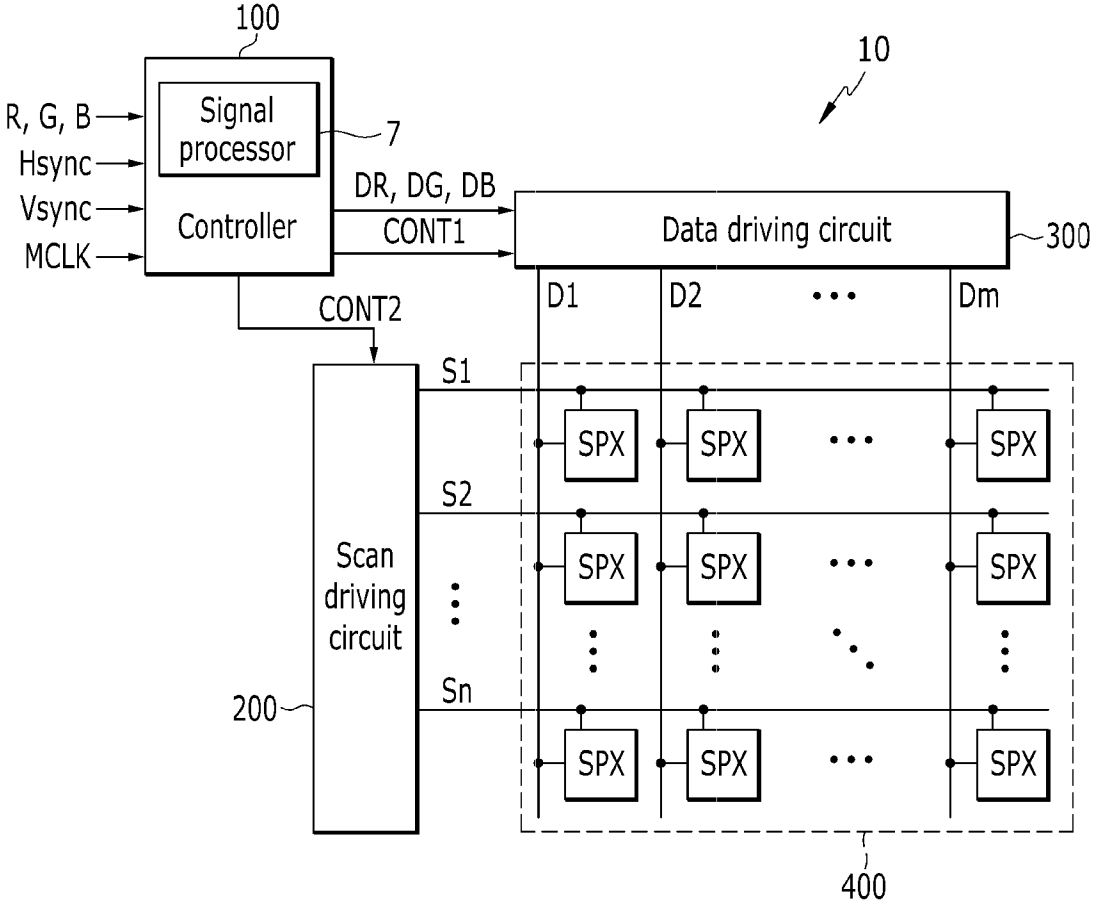
FIG. 6 is a block diagram illustrating an exemplary embodiment of a display device including a signal processing circuit according to the invention.

FIG. 6 is a block diagram illustrating an exemplary embodiment of a display device including a signal processing circuit according to the invention.

In an exemplary embodiment, as shown in FIG. 6, the display device 10 includes a controller 100, a scan driving circuit 200, a data driving circuit 300 and a display unit 400.

The controller 100 receives input video signals R, G, B and an input control signal to control display of the input video signals R, G, B. The input video signals R, G, B include luminance information of each pixel PX, and the luminance information includes a predetermined number of grayscales, for example, $1024=2^{10}$, $256=2^{8}$, or $64=2^{6}$ of grayscales. The input control signal includes a vertical synchronization signal Vsync, a horizontal synchronization signal Hsync and a main clock signal MCLK.

The controller 100 processes the input video signals R, G, B suited to operation conditions of the display unit 400 and the data driving circuit 300 to generate image data signals DR, DG, DB. When the controller 100 processes the input video signals R, G, B to generate the image data signals DR, DG, DB, the above-mentioned signal processor may be used.

In one exemplary embodiment, for example, as shown in FIG. 6, the controller 100 includes the signal processor 7, converts red-green image data RG and blue-green image data BG from the signal processor 7 into gamma voltage data based on gamma characteristics of the display device 1, converts data to limit a current flowing through the display device 10, or generates image data signals DR, DG, DB by performing a compensation operation such as degradation compensation, IR-drop compensation and threshold voltage deviation compensation, for example.

An operation of generating image data signals DR, DG, DB according to red-green image data RG and blue-green image data BG generated from the controller 100 is not limited to the operations described above.

Image data and input image data in the signal processor and the signal processing method described with reference to FIGS. 4 and 5 are data corresponding to an input video signal indicating a grayscale value of one subpixel. Accordingly, the signal processor 7 generates a plurality of the first input image data and a plurality of the second input image data by an exemplary embodiment of the signal processing method according to the invention.

The signal processor 7 may sequentially perform a rendering operation for a plurality of input image data in one line unit, or may simultaneously perform a rendering operation for at least two input image data.

The controller 100 generates a data control signal CONT1 and a scan control signal CONT2 based on the input control signal.

The controller 100 may divide the input video signals R, G, B in synchronization with the vertical synchronization signal Vsync for each frame, and may identify the input video signals R, G, B in synchronization with the horizontal synchronization signal Hsync to arrange the image data signals DR, DG, DB. The controller 100 transfers the scan control signal CONT2 to the scan driving circuit 200, and transfers the data control signal CONT1 and the image data signals DR, DG, DB to the data driving circuit 300.

The scan driving circuit 200 transfers a plurality of scan signals S1-Sn to a plurality of scan lines S1-Sn based on the scan control signal CONT2. The data driving circuit 300 generates a plurality of data signals corresponding to the image data signals DR, DG, DB, and transfers the data signals to a plurality of data lines D1-Dm based on the data control signal CONT1.

The display unit 400 includes the data lines D1-Dm extending substantially in a first direction, the scan lines S1-Sn extending substantially in a second direction, and a plurality of subpixels SPX arranged substantially in a matrix form. In an exemplary embodiment, the first direction may be a pixel column direction, and the second direction may be a pixel row direction.

The data lines D1-Dm and the scan lines S1-Sn are connected to the subpixels SPX.

The subpixels SPX may display one of red, green and blue colors. A plurality of data voltages corresponding to the image data signals DR, DG, DB are transferred to the subpixels SPX through the data lines D1-Dm. The scan signals to select the subpixels SPX of a row unit are transferred to the subpixels SPX through the scan lines S1-Sn.

The subpixels SPX may include an organic light emitting diode ("OLED") or a liquid crystal display ("LCD") circuit.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of processing input image data of a display device comprising a plurality of pixels, the plurality of pixels comprising a plurality of first pixels and a plurality of second pixels alternately arranged in horizontal and vertical directions, each first pixel consisting of a green subpixel and a red subpixel disposed in a diagonal direction relative to the horizontal and vertical directions and each second pixel consisting of a green subpixel and a blue subpixel disposed in the diagonal direction, the method comprising:

performing a gamma-conversion on a first input image data corresponding to the red subpixel in the each first pixel and a second input image data corresponding to the blue subpixel in the each second pixel;

distributing the gamma-converted first input image data corresponding to one of the first pixels, which corresponds to a center pixel, to the gamma-converted second image data of one of the second pixels by a first ratio, wherein the one of the second pixels is adjacent to the one of the first pixels in the vertical direction; and distributing the gamma-converted first input image data corresponding to the one of the first pixels to the gamma-converted second image data of another of the second pixels by a second ratio, wherein the another of the second pixels is adjacent to the one of the first pixels in the horizontal direction.

2. The method of claim 1, further comprising:

distributing the gamma-converted first input image data corresponding to the one of the first pixels to the gamma-converted second image data of the one of the first pixels by a third ratio.

3. The method of claim 2, wherein a sum of the first ratio, the second ratio and the third ratio is one.

4. The method of claim 2, further comprising:

distributing the gamma-converted first input image data corresponding to another of the second pixels in the vertical direction based on the one of the first pixels to the gamma-converted first image data of the one of the first pixels by the first ratio; and distributing the gamma-converted second input image data corresponding to another of the second pixels by the second ratio, wherein the another of the second pixels is adjacent to the one of the first pixels in the horizontal direction.

5. The method of claim 4, further comprising:

performing an inverse-gamma conversion on the first image data of the one of the first pixels.

6. The method of claim 5, further comprising:

summing the input image data corresponding to the green subpixel of the one of the first pixels and the inverse-gamma-converted image data of the one of the first pixels to output an output image data of the one of the first pixels.

7. A signal processor for processing input image data of a display device comprising a plurality of pixels, the plurality of pixels comprising a plurality of first pixels and a plurality of second pixels alternately arranged in horizontal and vertical directions, each first pixel comprising a green subpixel and a red subpixel disposed in a diagonal direction relative to the horizontal and vertical directions and each second pixel comprising a green subpixel and a blue subpixel disposed in the diagonal direction, the signal processor comprising:

an input gamma unit which performs a gamma-conversion on a first input image data corresponding to the red subpixel in the each first pixel and a second input image data corresponding to the blue subpixel in the each second pixel; and a subpixel rendering unit which distributes the gamma-converted first input image data corresponding to one of first pixels to the gamma-converted second image data of one of the second pixels by a first ratio, wherein the one of the second pixels is adjacent to the one of the first pixels in the vertical direction, and distributes the gamma-converted first input image data corresponding to the one of the first pixels to the gamma-converted second image data of another of the second pixels by a second ratio, wherein the anther of the second pixels is adjacent to the one of the first pixels in the horizontal direction.

8. The signal processor of claim 7, wherein the subpixel rendering unit distributes the gamma-converted input image data corresponding to the one of the first pixels to the gamma-converted second image data of the one of the first pixels by a third ratio.

9. The signal processor of claim 8, wherein a sum of the first ratio, the second ratio and the third ratio is one.

10. The signal processor of claim 8, wherein the subpixel rendering unit distributes the gamma-converted first input image data corresponding to another of the second pixels in the vertical direction based on the one of the first pixels to the gamma-converted first image data of the one of the first pixels by the first ratio, and distributes the gamma-converted second input image data corresponding to another of the second pixels by the second ratio, wherein the another of the second pixels is adjacent to the one of the first pixels in the horizontal direction.

11. The signal processor of claim 10, further comprising:

an output gamma unit which performs an inverse gamma-conversion on the first image data of the one of the first pixels.

12. The signal processor of claim 11, further comprising:

an output interface which sums input image data of the green subpixel and the inverse-gamma-converted first image data of the one of the first pixels to output an output image data of the one of the first pixels.

13. A display device comprising:

a plurality of pixels, the plurality of pixels comprising a plurality of first pixels and a plurality of second pixels alternately arranged in horizontal and vertical directions each first pixel consisting of a green subpixel and a red subpixel disposed in a diagonal direction relative to the horizontal and vertical directions and each second pixel consisting of a green subpixel and a blue subpixel disposed in the diagonal direction; and a signal processor which performs a gamma-conversion on a first input image data corresponding to the red subpixel in the each first pixel and a second input image data corresponding the blue subpixel in the each second pixel, distributes the gamma-converted first input image data corresponding to one of first pixels, which corresponds to a center pixel, to the gamma-converted second image data of the one of the first pixels in a vertical direction based on the center pixel by a first ratio, and distributes the gamma-converted first input image data corresponding to the one of the first pixels to the gamma-converted second image data of another of the second pixels by a second ratio, wherein the another of the second pixels is adjacent to the one of the first pixels in a horizontal direction.

14. The display device of claim 13, wherein the signal processor distributes the gamma-converted first input image data corresponding to the one of the first pixels to the gamma-converted second image data of the one of the first pixels by a third ratio.

15. The display device of claim 14, wherein a sum of the first ratio, the second ratio and the third ratio is one.

16. The display device of claim 14, wherein the signal processor distributes the gamma-converted first input image data corresponding to another of the second pixels in the vertical direction based on the one of the first pixels to the gamma-converted first image data of the one of the first pixels by the first ratio, and distributes the gamma-converted second input image data corresponding to another of the second pixels by the second ratio, wherein the another of the second pixels is adjacent to the one of the first pixels in the horizontal direction.

17. The display device of claim 16, wherein the signal processor comprises:

an output gamma unit which performs an inverse gamma-conversion on the first image data of the one of the first pixels.

18. The display device of claim 17, wherein the signal processor further comprises:

an output interface which sums input image data of the green subpixel and the inverse-gamma-converted first image data of the one of the first pixels to output an output image data of the one of the first pixels.

* * * * *